US007374385B2

(12) United States Patent
Parker

(10) Patent No.: US 7,374,385 B2
(45) Date of Patent: May 20, 2008

(54) METHOD OF MAKING A HARDCOVER BOOK AND HARDCOVER APPARATUS

(75) Inventor: Kevin P. Parker, Berkeley, CA (US)

(73) Assignee: Powis Parker Inc., Berkeley, CA (US)

( * ) Notice: Subject to any disclaimer, the term of this patent is extended or adjusted under 35 U.S.C. 154(b) by 459 days.

(21) Appl. No.: 10/653,495

(22) Filed: Sep. 2, 2003

(65) Prior Publication Data

US 2004/0066030 A1 Apr. 8, 2004

Related U.S. Application Data

(63) Continuation-in-part of application No. 10/262,721, filed on Oct. 2, 2002, now abandoned.

(51) Int. Cl.
*B42C 9/00* (2006.01)

(52) U.S. Cl. ..... 412/8; 412/4; 412/6; 412/19; 412/21; 412/28

(58) Field of Classification Search ..... 412/1, 412/3, 4, 6, 8, 9, 17, 19, 33, 36, 37; 281/21.1
See application file for complete search history.

(56) References Cited

U.S. PATENT DOCUMENTS

| | | | | |
|---|---|---|---|---|
| 2,294,347 A | | 8/1942 | Bauer | 154/46 |
| 3,080,178 A | * | 3/1963 | Brody | 281/34 |
| 3,367,680 A | * | 2/1968 | Greenspan | 281/37 |
| 3,532,363 A | * | 10/1970 | Abildgaard et al. | 281/29 |
| 3,608,115 A | * | 9/1971 | Chou et al. | 412/19 |
| 3,715,260 A | | 2/1973 | Dornemann et al. | 156/477 B |
| 3,749,422 A | | 7/1973 | Abildgaard et al. | 281/21 |
| 3,816,866 A | | 6/1974 | Miaskoff et al. | 11/3 |

(Continued)

FOREIGN PATENT DOCUMENTS

CA 991219 6/1976

(Continued)

OTHER PUBLICATIONS

Seal and View ®"Clear Label Protectors" Self Adhesive Stock No. CLL manufactured by Smead, Hastings Minnesota. (Admitted Prior Art).

(Continued)

*Primary Examiner*—Monica Carter
*Assistant Examiner*—Eric A. Gates
(74) *Attorney, Agent, or Firm*—Girard & Equitz LLP

(57) ABSTRACT

A method of fabricating a book from a stack of sheets and a hardcover assembly having first and second relatively rigid cover sections separated by a spine region. A layer of pressure sensitive adhesive is disposed over the inner surfaces of the cover sections, with there being a pair of release liners covering both the pressure sensitive adhesive layers. The first cover section is then secured to one side of the stack by sequentially removing the corresponding release liners so as to expose the underlying adhesive. The second cover section is then applied by folding the second cover section over the other side of the stack, removing the release liners and securing the cover section to the stack by way of the adhesive.

16 Claims, 14 Drawing Sheets

U.S. PATENT DOCUMENTS 3,825,963 A * 7/1974 Abildgaard et al. ..... 412/21
3,847,718 A 11/1974 Watson ..... 161/39
3,912,304 A 10/1975 Abildgaard et al. ..... 281/21.1
3,964,770 A 6/1976 Abildgaard et al. ..... 281/29
RE29,105 E 1/1977 Miaskoff et al. ..... 11/3
4,126,982 A 11/1978 Ito et al. ..... 53/593
4,129,914 A 12/1978 Jahn ..... 11/2
4,184,218 A 1/1980 Hawkes ..... 11/1 AD
4,299,410 A 11/1981 Jukola ..... 281/21 R
4,314,716 A 2/1982 Errichiello ..... 281/29
4,367,061 A * 1/1983 Wiholm ..... 412/3
4,377,430 A 3/1983 Bexley et al. ..... 156/184
4,385,225 A 5/1983 Giulie ..... 219/521
4,420,282 A 12/1983 Axelrod ..... 412/4
4,496,617 A 1/1985 Parker ..... 428/55
4,511,298 A 4/1985 Jones ..... 412/34
4,537,544 A 8/1985 Joost ..... 412/5
4,615,541 A 10/1986 Kwauka ..... 281/29
4,650,216 A 3/1987 Carlson ..... 281/34
4,762,341 A 8/1988 Rabuse ..... 281/29
4,800,110 A 1/1989 DuCorday ..... 428/43
4,898,506 A 2/1990 Lázár ..... 412/8
4,906,156 A 3/1990 Axelrod ..... 412/21
5,011,187 A * 4/1991 Hunder et al. ..... 281/15.1
5,013,200 A * 5/1991 Hunder et al. ..... 412/6
5,044,857 A 9/1991 Crudo ..... 412/19
5,052,872 A * 10/1991 Hunder et al. ..... 412/6
5,052,873 A 10/1991 Parker et al. ..... 412/13
5,066,183 A 11/1991 Tholérus ..... 412/4
5,078,563 A 1/1992 Lolli ..... 412/8
5,154,447 A 10/1992 Tooker ..... 281/21.1
5,174,556 A 12/1992 Taylor et al. ..... 270/1.1
5,193,962 A 3/1993 Parker et al. ..... 412/8
5,340,155 A 8/1994 Podosek ..... 281/29
5,346,350 A 9/1994 Luhman et al. ..... 412/37
5,364,215 A 11/1994 Snellman et al. ..... 412/3
5,452,920 A 9/1995 Parker ..... 281/21.1
5,569,011 A 10/1996 Yamaguchi et al. ..... 412/9
5,601,312 A 2/1997 Funkhouser ..... 281/21.1
5,601,915 A 2/1997 Ochi et al. ..... 428/323
5,605,425 A 2/1997 Schaefer ..... 412/4
5,613,711 A 3/1997 Parker ..... 281/21.1
5,683,111 A * 11/1997 Bass et al. ..... 281/21.1
5,727,816 A * 3/1998 Ong ..... 281/29
5,779,423 A 7/1998 Bermingham ..... 412/4
5,829,938 A 11/1998 Hartwig et al. ..... 412/8
5,833,423 A 11/1998 Yamaguchi et al. ..... 412/8
5,997,964 A 12/1999 Klima, Jr. ..... 428/1
6,010,157 A * 1/2000 Pierson et al. ..... 281/21.1
6,024,525 A 2/2000 Yamanaka ..... 412/36
6,056,493 A 5/2000 Hartwig et al. ..... 412/8
6,065,884 A 5/2000 Parker et al. ..... 400/611
6,155,763 A 12/2000 Parker et al. ..... 412/6
6,158,776 A 12/2000 Purcocks ..... 281/21.1
6,174,120 B1 1/2001 Kalisher ..... 412/1
6,322,867 B1 11/2001 Rush et al. ..... 428/40.1
6,332,630 B1 12/2001 Wolff et al. ..... 281/29
6,530,339 B1 * 3/2003 Silverbrook ..... 118/46
6,599,074 B2 7/2003 Parker ..... 412/33
6,619,900 B2 9/2003 Cobene, II et al. ..... 412/1
6,632,060 B1 * 10/2003 Gilmore et al. ..... 412/9
6,641,345 B2 11/2003 Cobene, II et al. ..... 412/1
6,685,415 B2 2/2004 Rush et al. ..... 412/37
6,709,727 B1 * 3/2004 Parker ..... 428/40.1
2002/0064437 A1 5/2002 Kuramoto et al.
2004/0066029 A1 * 4/2004 Parker ..... 281/4
2004/0066030 A1 * 4/2004 Parker ..... 281/21.1
2004/0067123 A1 * 4/2004 Parker et al. ..... 412/19
2004/0120794 A1 * 6/2004 Parker ..... 412/8
2006/0034672 A1 * 2/2006 VanDeWalle et al. ..... 412/33
2006/0083604 A1 * 4/2006 Parker ..... 412/19
2006/0115347 A1 * 6/2006 Parker et al. ..... 412/19

FOREIGN PATENT DOCUMENTS

EP 0404751 A1 12/1990
JP 403227698 A 10/1991 ..... 312/184
WO WO9939917 A1 * 8/1999

OTHER PUBLICATIONS

PCT Publication No. WO 99/39917, Publication Date Aug. 12, 1999.

* cited by examiner

Prior Art

METHOD OF MAKING A HARDCOVER BOOK AND HARDCOVER APPARATUS

CROSS REFERENCE TO RELATED APPLICATIONS

The present application is a continuation-in-part application of application Ser. No. 10/262,721 filed on Oct. 2, 2002 now abandoned and entitled "Method and Apparatus of Making a Hardcover Book and Hardcover Apparatus".

BACKGROUND OF THE INVENTION

1. Field of the Invention

The present invention relates generally to the field of bookbinding and, in particular, to a method of fabricating binding a hardcover book using a binder strip and a separate hardcover assembly and to the hardcover assembly itself.

2. Description of Related Art

Binding systems for binding stacks of sheets into a book using desktop equipment have increased in popularity. One popular system uses a binder strip having and adhesive surface, such as disclosed in U.S. Pat. No. 4,496,617. The binder strip is typically applied to a stack of sheets to be bound using a desktop binding machine such as disclosed in U.S. Pat. No. 5,052,873. The binding machine carries out the binding operation by suitably positioning the binder strip relative to the stack to be bound and applying heat and pressure so that the edges of the stack are bound. The bound stack does not, however, have the same general appearance as books using commercial binding processes, particularly that of hardcover books.

Various approaches have been used to produce bound books using desktop equipment that closely resembles hardcover books. One example is disclosed in U.S. Pat. No. 6,155,763 that uses specialized covers having an adhesive layer for binding the stack as opposed to using a conventional binder strip. A company located in Finland and believed to be called Instant Cover Europe Ltd has developed another approach. The stack to be bound is first bound together using the above-described binder strips and binding machine. A hardcover is then applied using high tack adhesives. A positioning apparatus is used to assist in the application of the hardcover to the bound stack to ensure that the cover is accurately positioned over the stack. Unfortunately, the positioning apparatus is relatively complex and includes, for example, a mirror to assist in the assembly. A user having little training is likely to have some difficulty in carrying out the binding process.

There is a need for a binding process using desktop equipment that can be carried out by users having relatively little training and yet produces a hardcover book that compares favorably in appearance with commercially bound books.

SUMMARY OF THE INVENTION

A method of fabricating a hardcover book is disclosed using a hardcover assembly and a previously bound stack of sheets. The hardcover assembly includes first and second relatively rigid cover sections separated by a spine section, with the first cover section including a first pressure sensitive adhesive layer and first and second release liners disposed over the first pressure sensitive adhesive layer.

The method includes separating the first release liner from the first cover section thereby exposing a first portion of the first pressure sensitive adhesive. The bound stack and the first cover section are positioned so that the bound stack comes in contact with the exposed first portion of the first pressure sensitive adhesive layer. The second release liner is separated from the first cover section thereby exposing a second portion of the first pressure sensitive adhesive layer. The bound stack and the second portion of the first pressure sensitive adhesive are the brought into contact with one another.

DETAILED DESCRIPTION OF THE INVENTION

Figure 1:
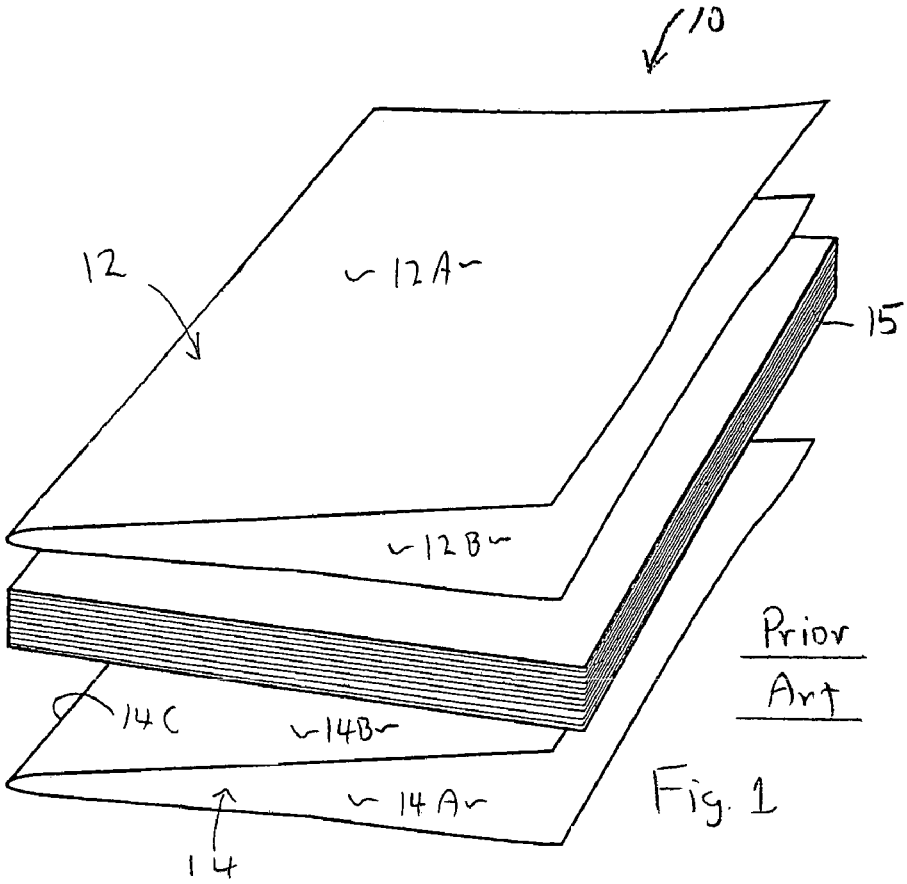
Fig. 1 Prior Art
FIG. 1 is a perspective view of a stack of sheets to be bound, including the front and back folded liner sheets.

Referring now to the drawings, FIG. 1 shows a stack of sheets 15 to be bound. A first folded liner sheet 12, forming sheets 12A and 12B the same size as the sheets to be bound, is positioned on the top of the stack 15 and a second folded liner sheet 14, forming sheets 14A and 14B, is positioned on the bottom of the stack. The liner sheets 12 and 14 are preferably of a relatively heavy stock as compared to the sheets 15 to be bound. Once the liner sheets 12, 14 and stack of sheets 15 have been assembled, the combined stack 10 is bound together using a conventional binder strip 16 as described in U.S. Pat. No. 4,496,617, the contents of which are hereby fully incorporated by reference into the present application. The actual binding is preferably is carried out using a desktop binding machine as described in U.S. Pat. No. 5,052,873, the contents of which are hereby fully incorporated by reference into the present application. The bound stack 10 is shown in FIG. 2, with the adhesive present in the binder strip 16 operating to bind the individual sheets together and to the paper substrate of the binder strip 16.

Figure 2:
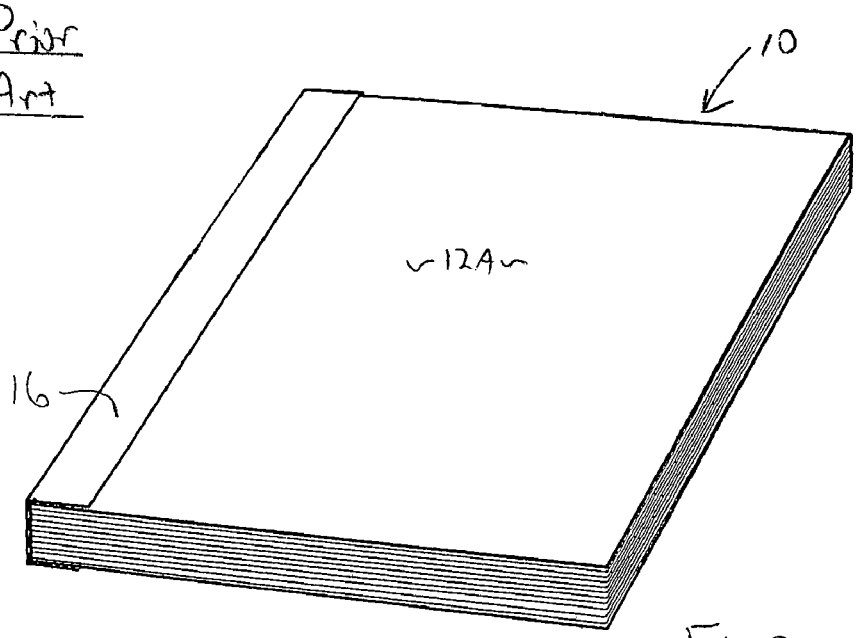
FIG. 2 is a perspective view of the stack of sheets of FIG. 1 after binding using a conventional binder strip.
Figure 3:
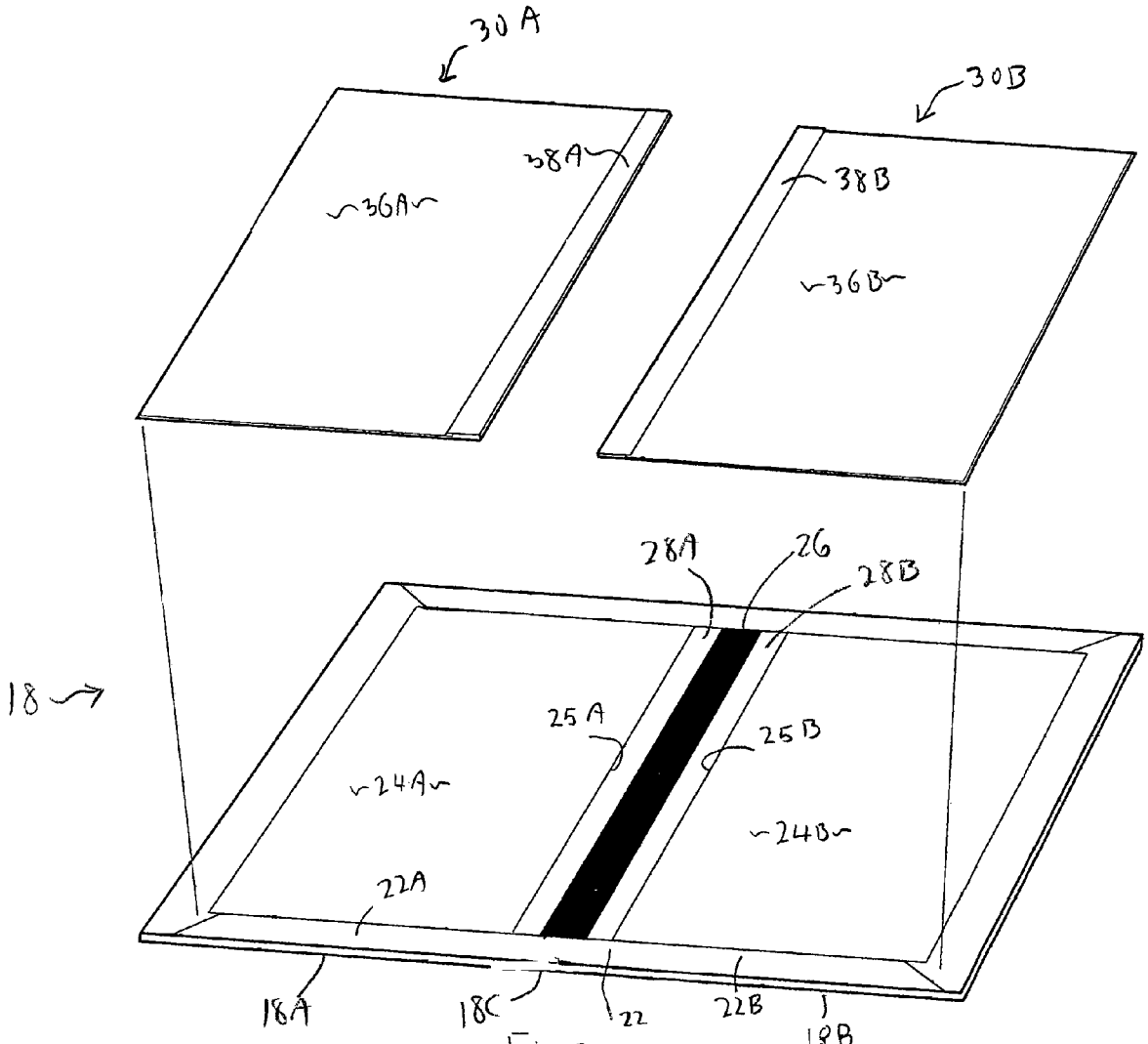
FIG. 3 is a perspective exploded view of the hardcover assembly, with the pressure sensitive front and rear sheets structures shown displaced from the remainder of the assembly.

FIG. 3 shows details of the hardcover assembly 18 that is applied to the bound stack 10 of FIG. 2. Preferably, the cover assembly 18 is completely assembled and sold separately to the user. As will be described, the cover assembly 18 will be manufactured in various sizes to accommodate differing size stacks 10 in terms of stack thickness. It is further anticipated that a user can request that certain information be preprinted on the assembly 18, including title information and any other graphics. As will be described, hardcover assembly 18 includes the front and back cover sections halves 18A and 18B, respectively, separated by a spine section 18C.

The cover assembly includes a pair of relatively stiff cover boards 24A and 24B made of cardboard or the like. The cover boards 24A and 24B are typically 8⅜ inches by 11 5/16 inches for binding 8½ by 11 inch stack 10. The cover boards are covered with a flexible cover membrane 22, typically fabric, which is folded around the edges of the cover boards, as depicted in FIG. 3. That part of the cover membrane 22 disposed intermediate the opposite edges 25A and 25B of the cover boards is unsupported and is thus relatively flexible. A length of fabric or stiff paper, typically 0.010 inches thick, is preferably disposed in the spine section 18C of the hardcover assembly 18 so as to slightly stiffen the membrane 22 in that location so that a desired shape is achieved when the bound book is opened and closed. The membrane regions 28A and 28B disposed between the respective edges of the spine section 26 and the respective edges 25A and 25B of the cover boards 24A and 24B are referred to as gutter regions. The gutter regions 28A and 28B are each fixed in width at ⅜ of an inch. The gutter regions define the flexible portion of the cover membrane. Alternatively, a spine board (not depicted), made of the same material as the cover boards 24A and 24B and having a shape that generally corresponds that of spine region 26, can be used. The spine board, which is typically 0.088 inches thick, functions to stiffen the spine 26, with most of the spine flexibility being provided by the flexible gutter regions 28A and 28B disposed between the respective edges of the cover boards 24A and 24B and the respective edges of the spine board. When the spine board is used, the gutter region 28A and 28B widths are preferably increased slightly to 7/16 of an inch.

The spine region 26 width varies, along with the width of the spine board if one is used, depending upon the width of the stack 10 to be bound. The cover assemblies are preferably prefabricated in various widths to accommodate stacks 10 of various widths as set forth below in Table 1.

TABLE 1

| Model | Spine 26 Width (inches) | Stack Thickness (inches) |
|---|---|---|
| A | ⅜ | To ¼ |
| B | ½ | ¼ to ½ |
| C | ¾ | ½ to ¾ |
| D | 1 | ¾ to 1 |
| E | 1¼ | 1 to 1¼ |
| F | 1½ | 1¼ to 1½ |

The number of available spine widths can be increased or decreased from the values set forth above in Table 1, with a larger number increasing the difficulty of maintaining an adequate inventory and a smaller number detracting somewhat from the appearance of the final product in the spine region.

Figure 4:
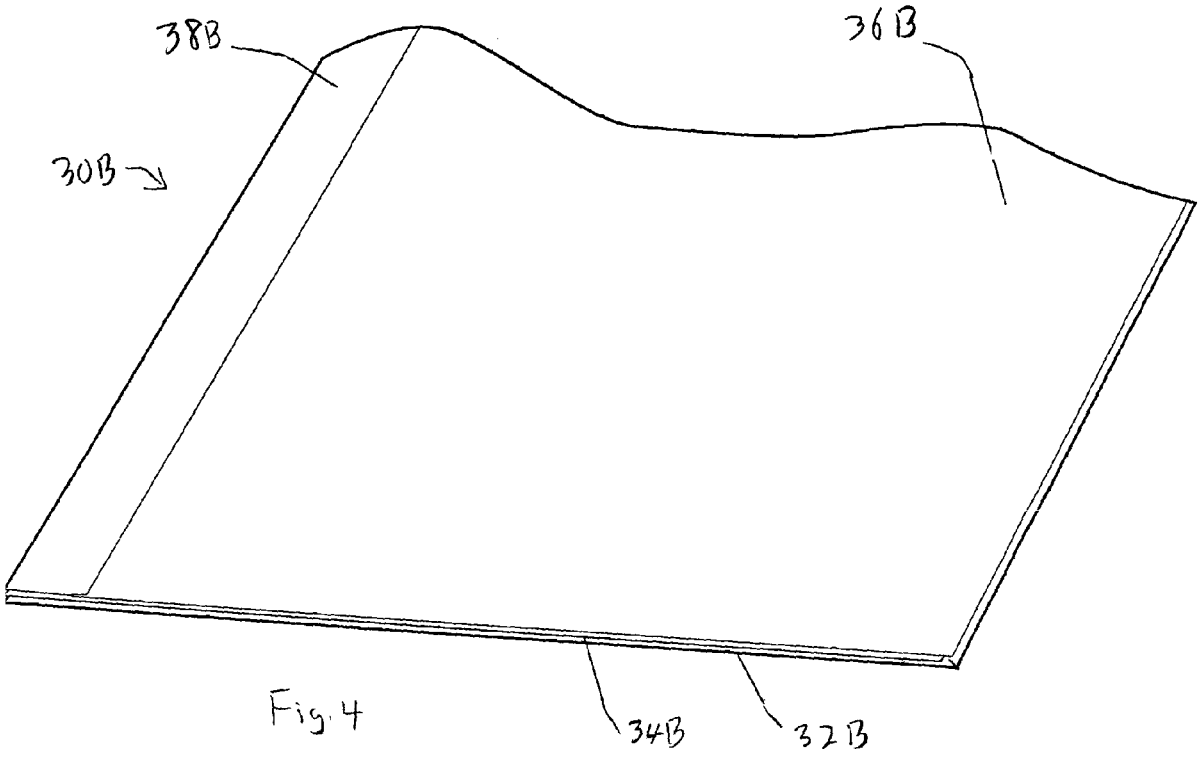
FIG. 4 is a perspective view of one of the two pressure sensitive adhesive sheet structures.
Figure 5:
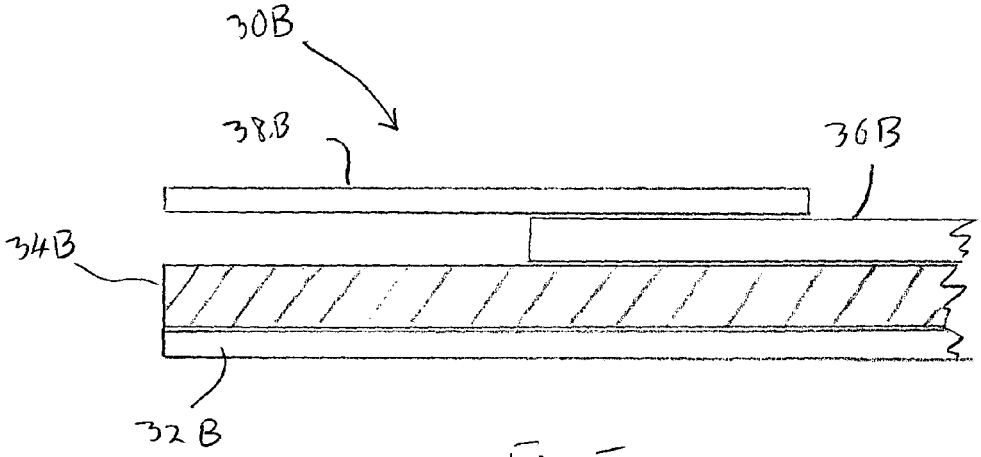
FIG. 5 is a cross-section elevational view of a portion of the adhesive sheet structure of FIG. 4.

Referring back to FIG. 3, the cover assembly 18 is prefabricated using a pair of pressure sensitive adhesive sheets structure 30A and 30B. Further details of the adhesive sheets are also shown in FIGS. 4 and 5. Adhesive sheet structures 30A and 30B are dimensioned 8¼ by 10¾ inches when the stack 10 size is 8½ by 11 inches, to cover the interior periphery of the folded portions of the cover membrane 22A and 22B and to further secure the periphery of the membrane to the respective cover boards 24A and 24B. The smaller size of the underlying sheets 32A and 32B of the sheet structure ensures that the folded liner sheets 12A and 14A completely cover sheets 32A and 32B despite any small misalignment. Each sheet structure includes a respective bottom sheets 32A and 32B and an upper major release liner 36A and 36B. A layer of pressure sensitive adhesive 34A and 34B is disposed intermediate that upper liner and bottom sheet. A pressure sensitive adhesive manufactured by National Starch and Chemical Company and marketed under the designation Instant-Lok, type HL PSA 20-81, has been found suitable for this application. The adhesive layers 34A and 34B are preferably 0.003 to 0.004 inches in thickness.

The upper major release liners 36A and 36B are disposed over a majority of the underlying pressure sensitive adhesive layers. Generally, at least 75% of the adhesive layers are covered by the respective upper major release liners 36A and 36B, with a remaining strip of the adhesive along the inner edge of the sheet structures not being covered by the major release liners 36A and 36B. Instead, upper minor release liners 38A and 38B are disposed over the exposed adhesive strips. This relationship is shown schematically in FIG. 5 (not to scale) where a portion of the sheet structure 30B is depicted. As can be seen, the pressure sensitive adhesive layer 34B is disposed between the bottom sheet 32B and upper major and minor release liners 36B and 38B. That portion of the adhesive layer 34B not covered by the upper major release liner 36 is covered by a separate upper minor release liner 38B. The minor release liner 38B is actually positioned contacting the adhesive layer 34B and is secured in place by the adhesive layer. As is well known, all of the release liners 36A, 38A, 36B and 38B are fabricated from a material that only slightly adheres to the pressure sensitive adhesive so that the release liners can be manually separated from the adhesive without damage to the adhesive or the release liners. As part of the prefabrication of the hardcover assembly, conventional case glue 56 (not depicted in FIGS. 4 and 5) is applied to the top of the cover sections 18A and 18B and to the bottom sheets 32A and 32B. The sheet structures are then positioned over the respective cover sections 18A and 18B as shown in FIG. 3 so that the sheet structures will be secured to the cover sections by the case glue. Thus, the sheet structures 30A and 30B are secured to the cover boards 24A and 24B and to the peripheral portions of the cover membrane 22 by way of the case glue. This completes the prefabrication of the hardcover assembly 18.

Figure 6:
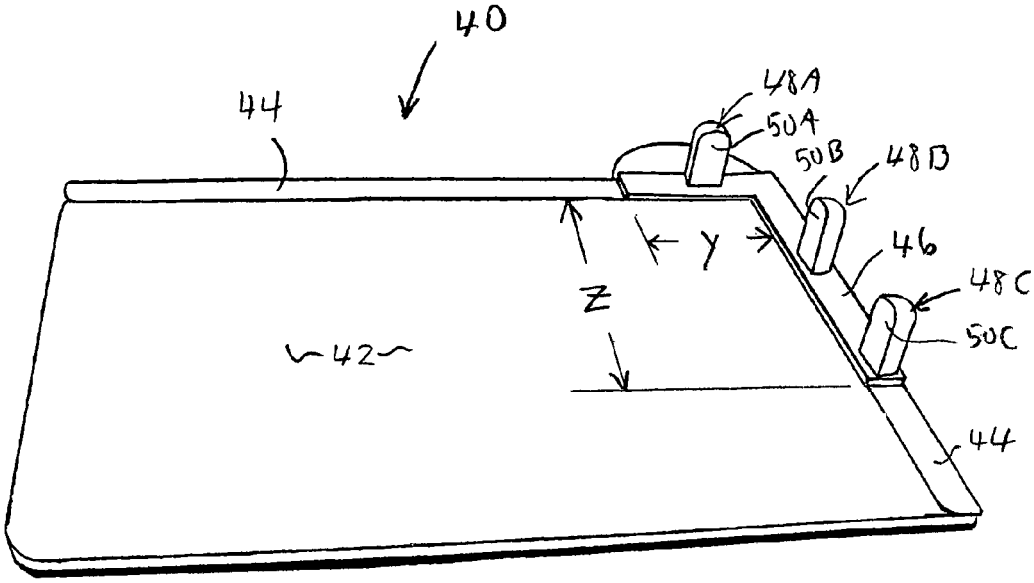
FIG. 6 is a perspective view of the guide apparatus used to attach the hardcover assembly to the bound stack.
Figure 7:
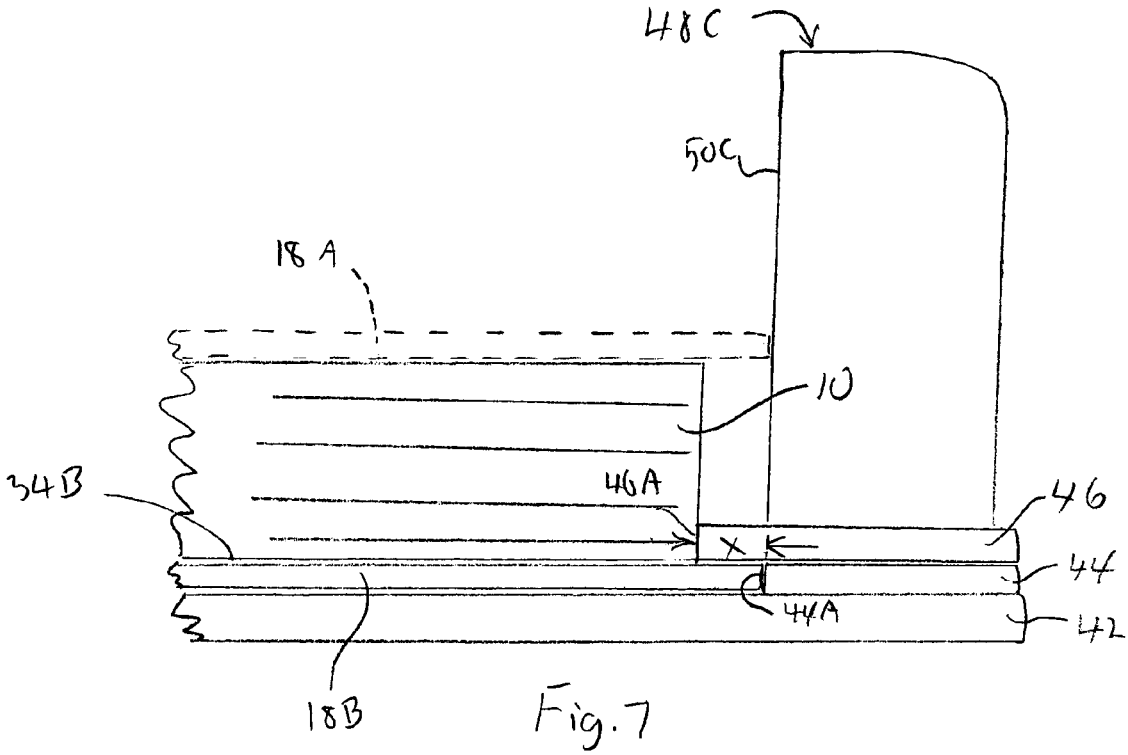
FIG. 7 is an expanded side view of a portion of the guide apparatus of FIG. 6 with a stack to be bound shown in position.

Referring now to FIGS. 6 and 7, a guide apparatus 40 is disclosed for use in carrying out the binding process. The guide apparatus includes a flat base member having a receiving surface 42 that is somewhat larger that the largest book to be bound when the book is in the open position. A stop member 44 having two orthogonal segments is supported on the upper surface 42 of the base member and extends around two adjacent sides of the base member. A ledge member 46, also having two orthogonal segments, is supported above the stop member 44 and, as can be in FIG. 7, have outer edges 46A which extend past the edge 44A of the stop member a small distance X, with the overhang being typically 0.16 inches. The height of the ledge member above the support surface is great enough to accommodate the thickness of the cover sections 18A and 18B of the cover assembly 18. The ledge member 46 extends along stop member 44 in one direction a distance Y (FIG. 6) that is somewhat smaller than the closed width of the smallest book to be bound. The distance Z, the distance that the ledge member 46 extends along stop member 44 in the other direction, is typically about twice dimension Y.

The guide apparatus 40 also preferably includes two or more vertical stop members, such as 48A, 48B and 48C, with vertical stop member 48A being supported on ledge member 46 about one third of the distance Y of the ledge member from the corner formed by the intersection of the two ledge member 46 segments. Vertical stop member 48B and 48C are at approximate equal distances along the other ledge member 46 segment. As can best be seen in FIG. 7, the vertical stop members each have a planar surface, surface 50C for example, that coincides with the inner edge, edge 44A for example, of the stop member. This configuration also applies to the planar surfaces 50A and 50B of vertical stop members 48A and 48B.

Figure 8A:
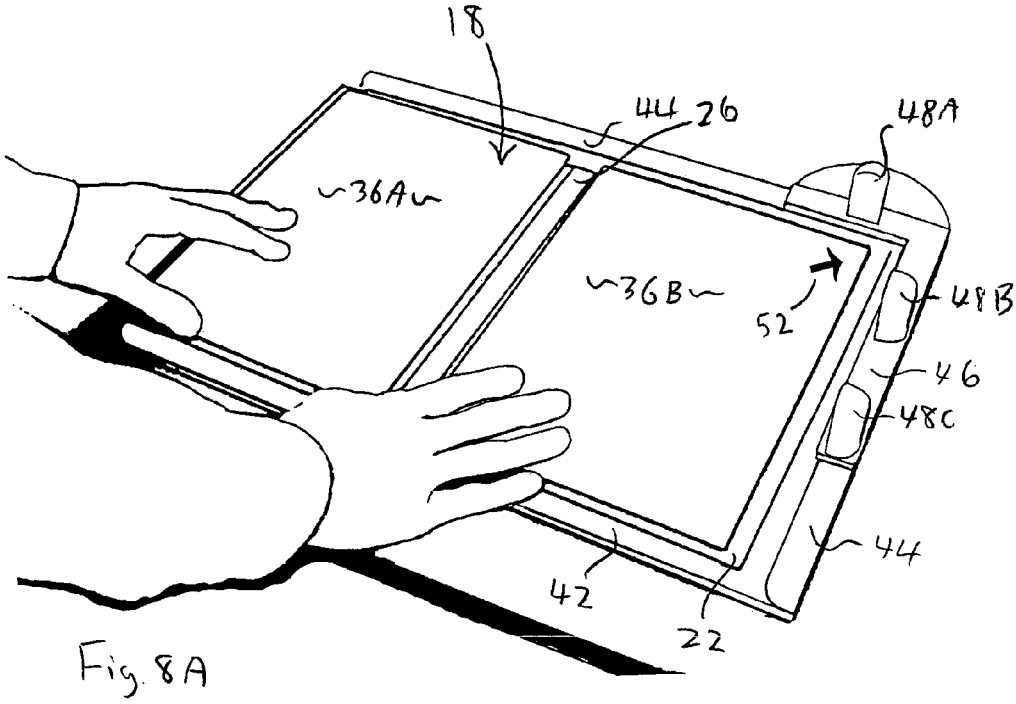
FIGS. 8A-8M depict the process for assembling the bound book.

The book binding sequence will now be described, starting with reference to FIG. 8A. The opened hardcover assembly 18 is first positioned on the guide apparatus receiving surface 42, with the upper release liners 36A and 36B facing upwards. As indicated by arrow 52, the hardcover assembly is moved along the surface 42 of the guide apparatus until the edges of cover section 18B is positioned under the ledge member 46, abutting the inner edge 44A of the stop member 44A, as shown in FIG. 7. Thus, the outer edge 46A of the ledge member 46 will be positioned a fixed distance X from the edge of cover 18B along the full length of both orthogonal segments of the ledge member 46. The outer edge 46A will provide a guide for positioning the bound stack 10, as will be described.

Figure 8B:
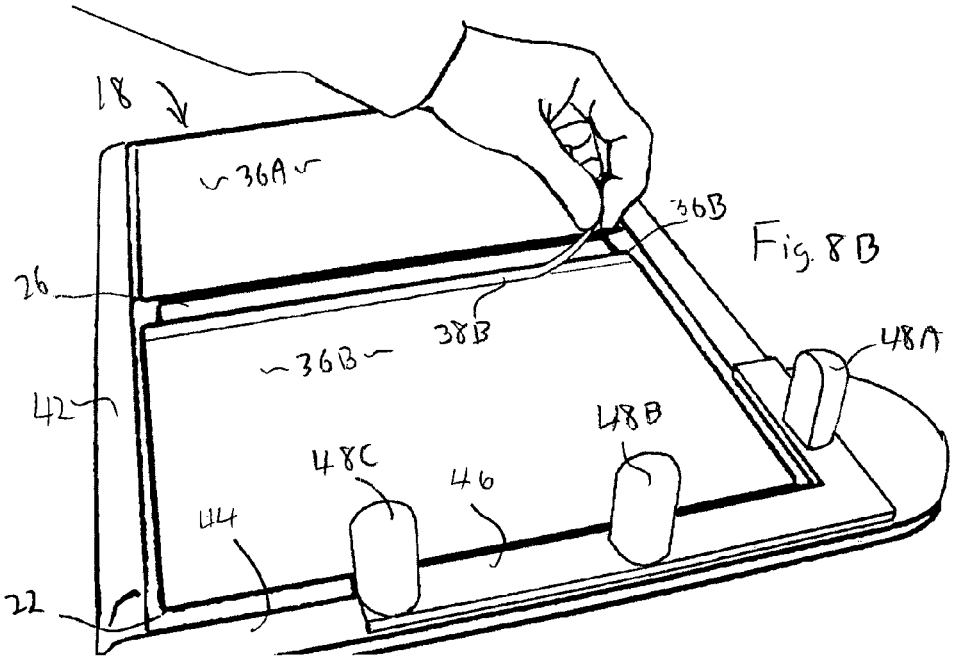
Figure 8C:
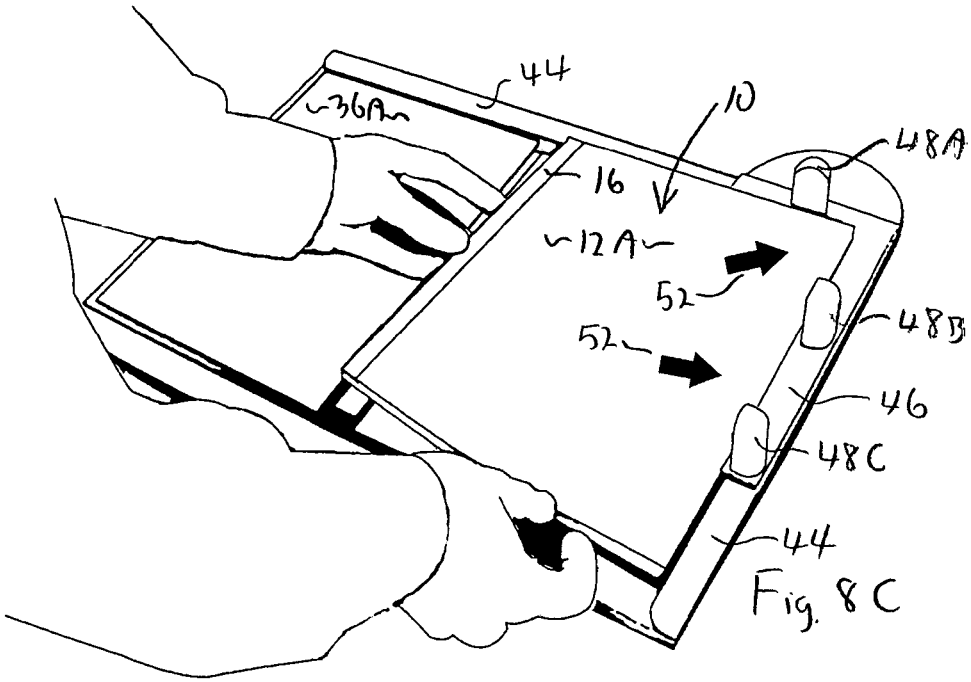
Figure 8D:
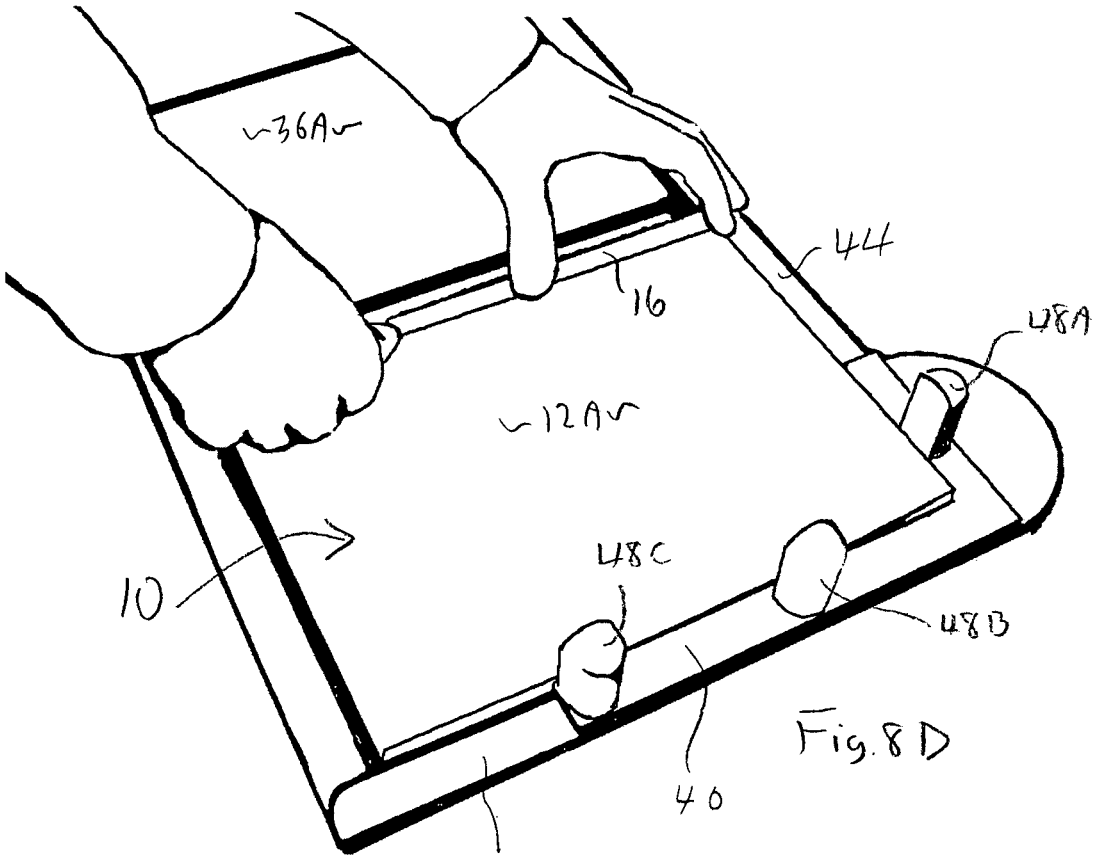

Once the hardcover assembly 18 is properly positioned on the guide apparatus 40, the user manually separates the upper minor release liner 38B as shown in FIG. 8B from the assembly 18. This will expose a relatively narrow strip of the underlying pressure sensitive adhesive 34B adjacent spine region 26. Next, the bound stack 10 is placed over the upper major release liner 36B, with the edges of the stack engaging edge 46A of the ledge member 46 along both orthogonal segments. FIG. 7 shows the edge of stack 10 engaging edge 46A along one of the two segments. As shown in FIG. 8C by arrows 52, that portion of stack 10 along the exposed adhesive 34B is not placed on the exposed adhesive until the orthogonal edges of the stack are positioned against edge 46A of both segments. Once the correct position is achieved, the stack is forced down upon the exposed pressure sensitive adhesive 34B as shown in FIG. 8D. This operates to secure the folded liner sheet 14A of stack 10 to cover section 18B of the hardcover assembly 18 in a correctly aligned position.

Figure 8E:
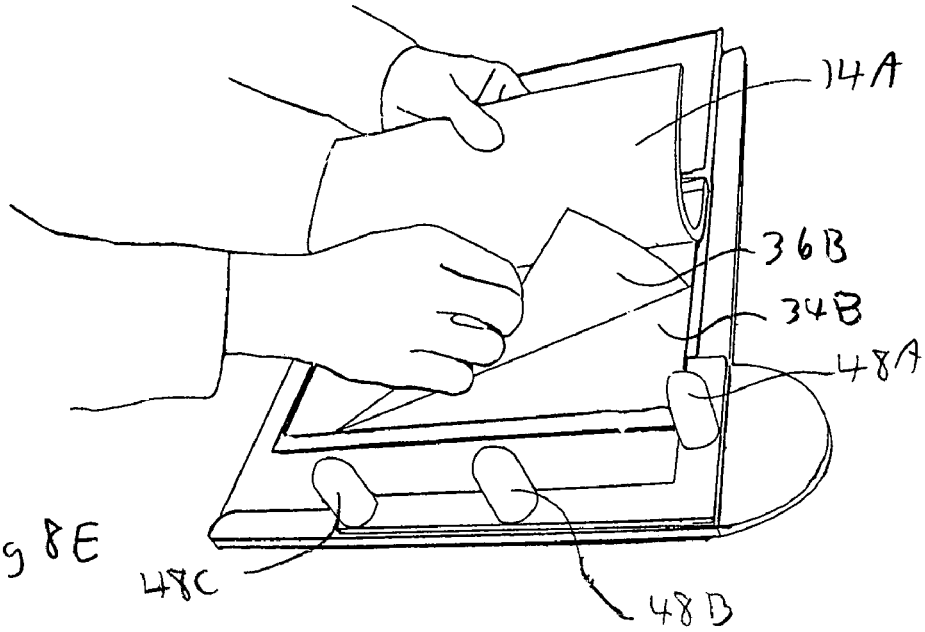
Figure 8F:
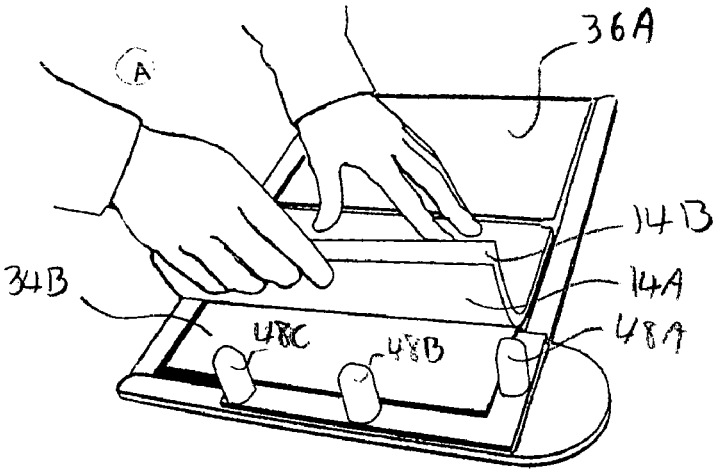
Figure 8G:
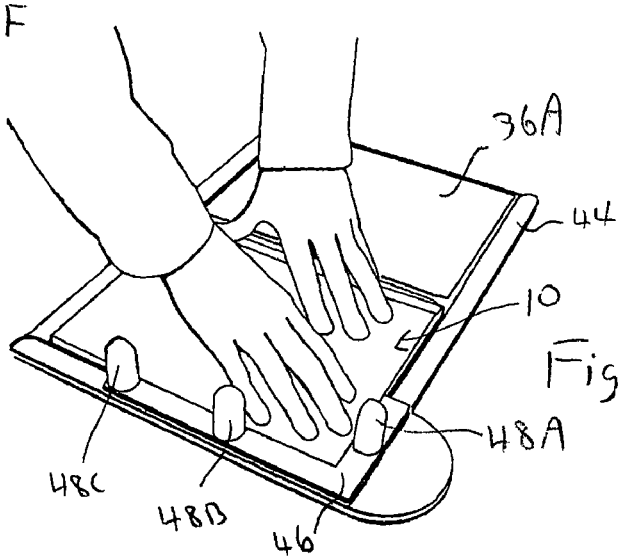

The next step is to secure the remainder of the folded liner sheet 14A of stack 10 to the adhesive 34B of assembly 18. Referring to FIG. 8E, the free edge of stack 10, including liner sheet 14A, is lifted up and rotated away from the upper major release liner 36B. This permits the release liner 36B to be separated from the hardcover assembly 18 thereby exposing the remainder of the pressure sensitive adhesive 34B. As shown in FIG. 8F, the spine portion of stack 10 held down against the hardcover assembly 18 with one hand while stack 10 is rotated over the adhesive 34B with the other hand. As shown in FIG. 8G, the user then presses the stack 10 down on the hardcover assembly 18. This causes the remainder of the liner sheet 14A of the stack to be secured by the remainder of adhesive 34B to cover section 18B of the hardcover assembly 18. The second cover section 18A of the hardcover assembly will now be attached.

Figure 8H:
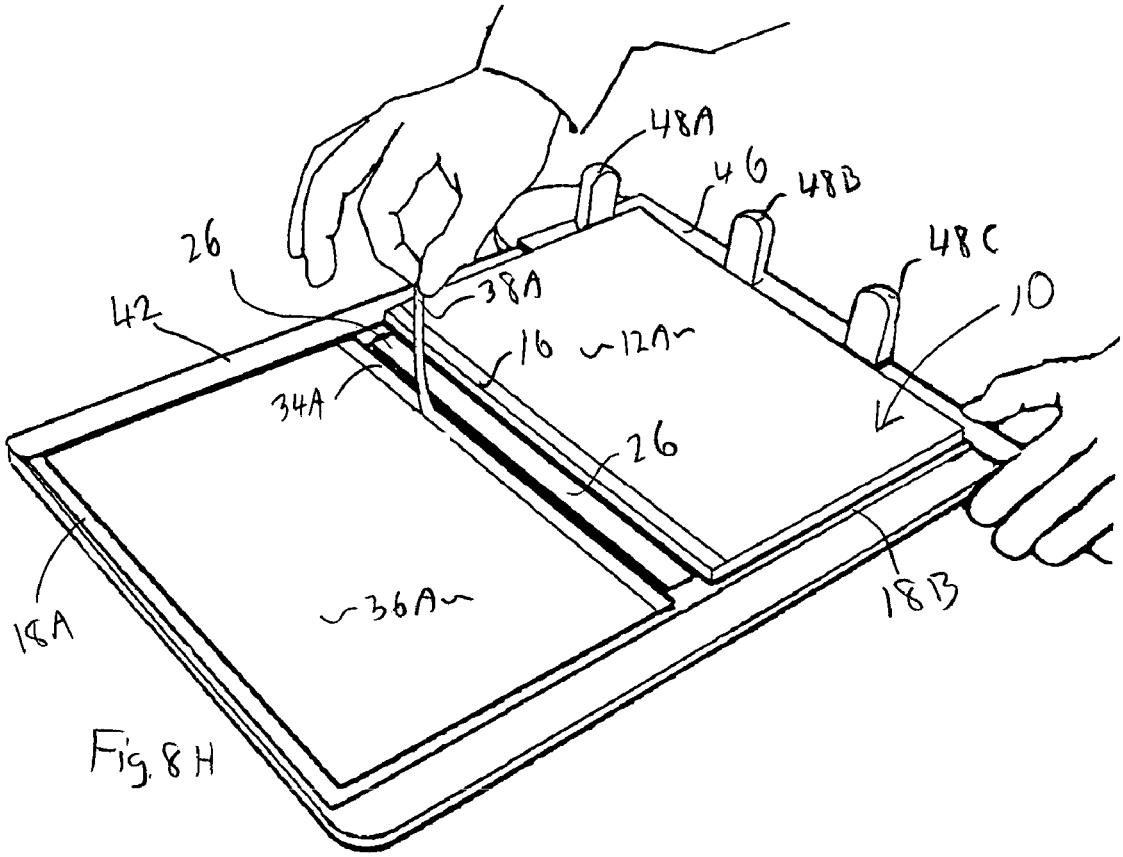
Figure 8I:
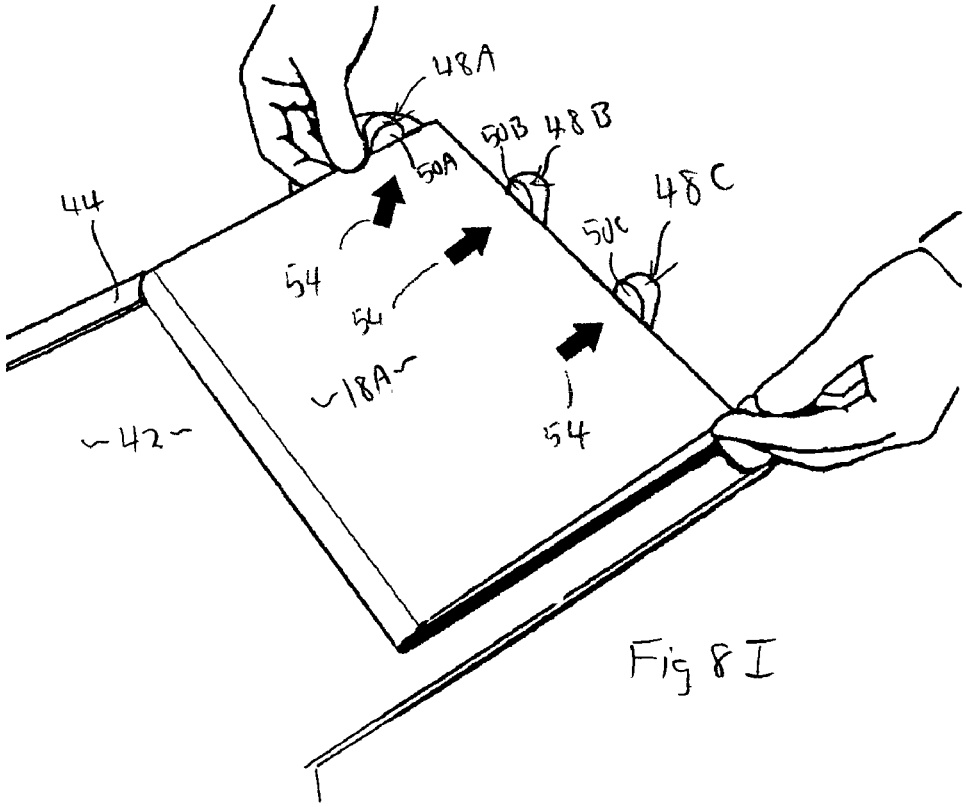
Figure 8J:
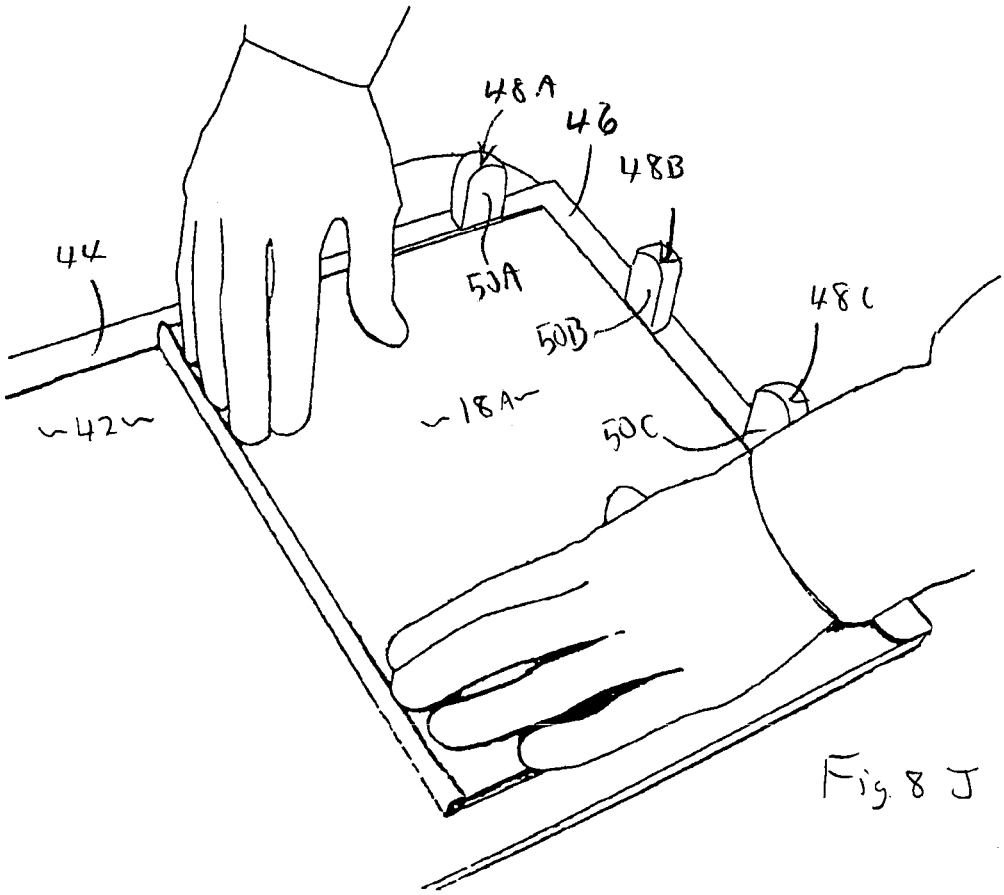

Referring to FIG. 8H, the upper minor release liner 38A is next separated from the hardcover assembly 18 thereby exposing a strip of pressure sensitive adhesive 34A adjacent spine region 26. The user then lifts the cover section 18A of the hardcover assembly away from the surface 42 of the guide apparatus and rotates the cover 18A around the spine. As indicated by arrows 54 of FIG. 8I, the cover section 18A is positioned so that the edges of the cover section 18A contact the planar surfaces 50A, 50B and 50C of the respective three vertical stop members 48A, 48B and 48C. This is shown in phantom in FIG. 7. The hardcover assembly 18 is then positioned correctly with respect to the bound stack 10. The user then forces the cover section 18A down as shown in FIG. 8J so that an edge of folded liner sheet 12A of stack 10 is secured to the hardcover assembly 18 by way of the exposed strip of adhesive 34A.

Figure 8K:
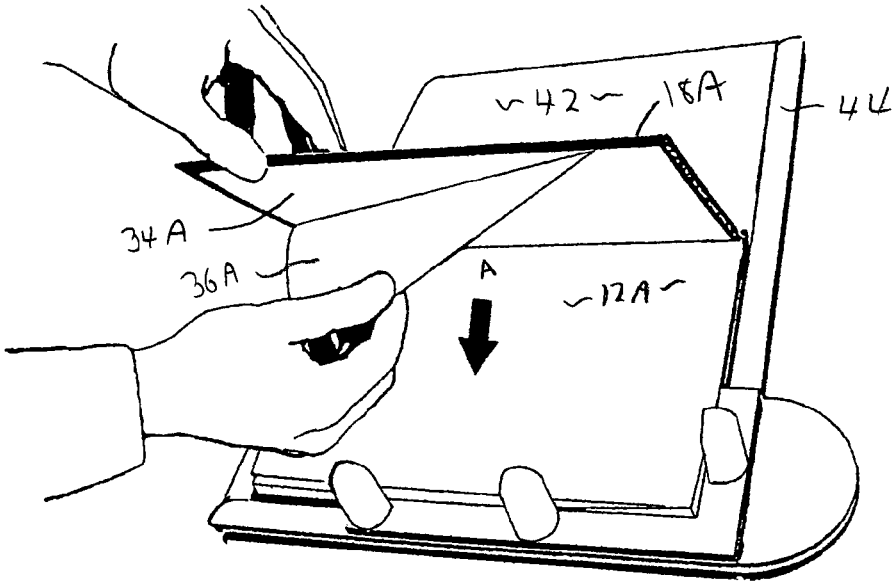
Figure 8L:
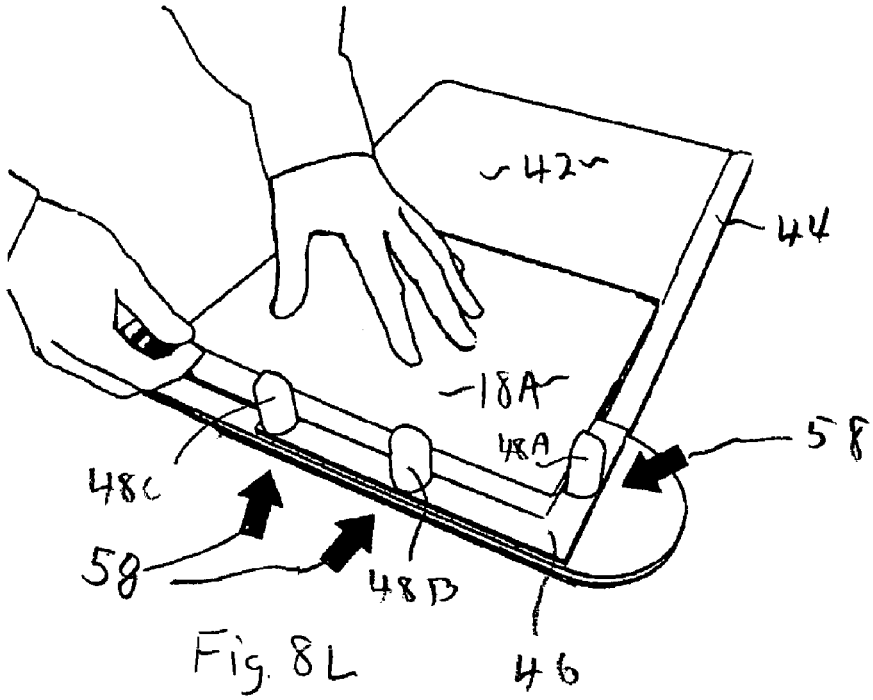
Figure 8M:
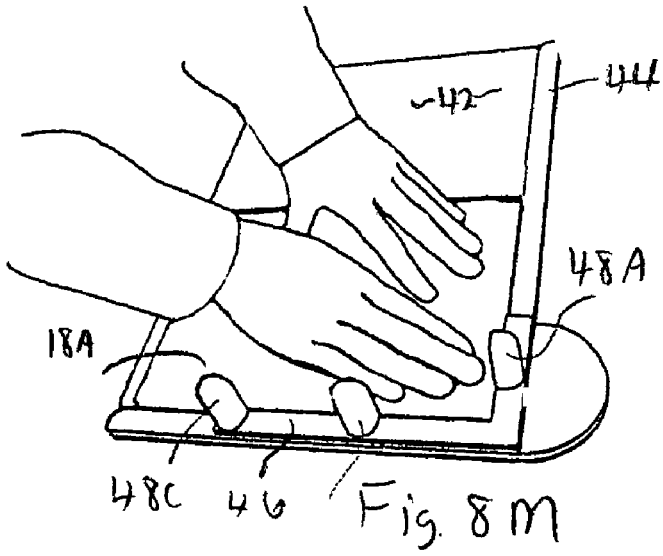

As shown in FIG. 8K, the user then lifts cover section 18A up and rotates the cover away from stack 10, with a narrow strip of liner sheet 12A of the stack remaining secured to cover section 18A. This permits upper major release liner 36A to be separated from hardcover assembly 18 thereby exposing the remainder of pressure sensitive adhesive layer 34A. Cover 18A is then placed rotated back down onto stack 10, where the edges of the cover should again be in contact with the surfaces 50A, 50B and 50C of the respective stops 48A, 48 and 48C as shown in FIG. 8L by arrows 58. The user then presses down on cover section 18A as shown in FIG. 8M thereby securing the cover section 18A to folded liner sheet 12A of stack 10. This completes the binding sequence.

Figure 9A:
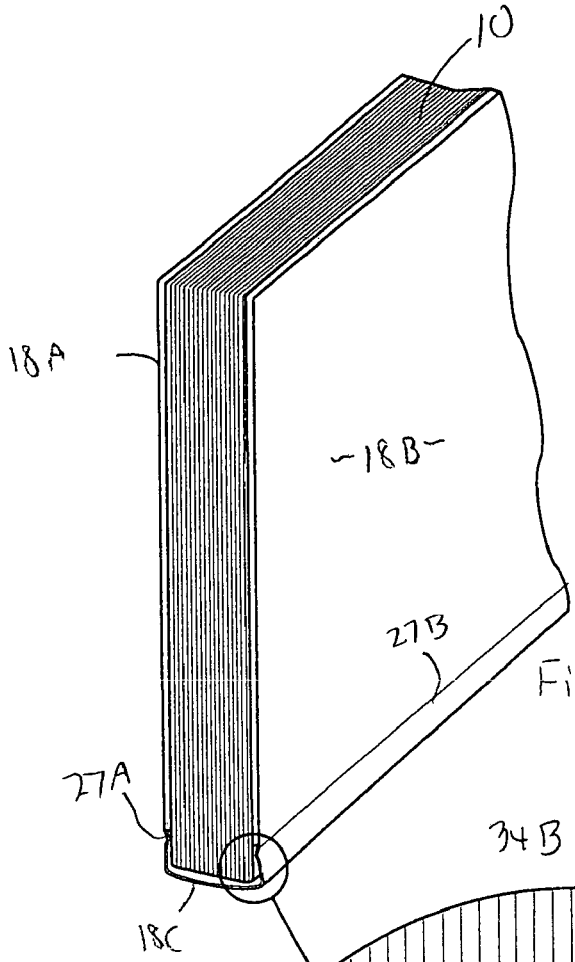
FIGS. 9A and 9B are perspective views of portions of the completed book.
Figure 9B:
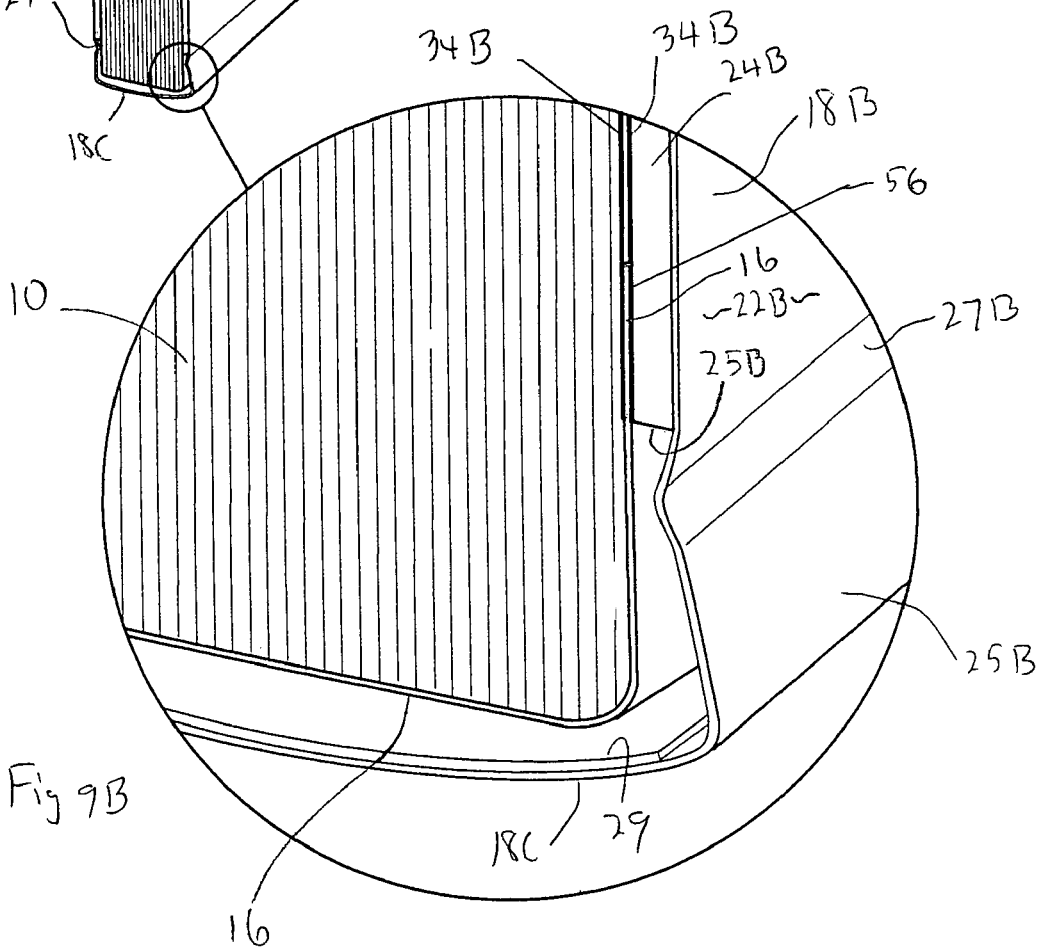
Figure 10:
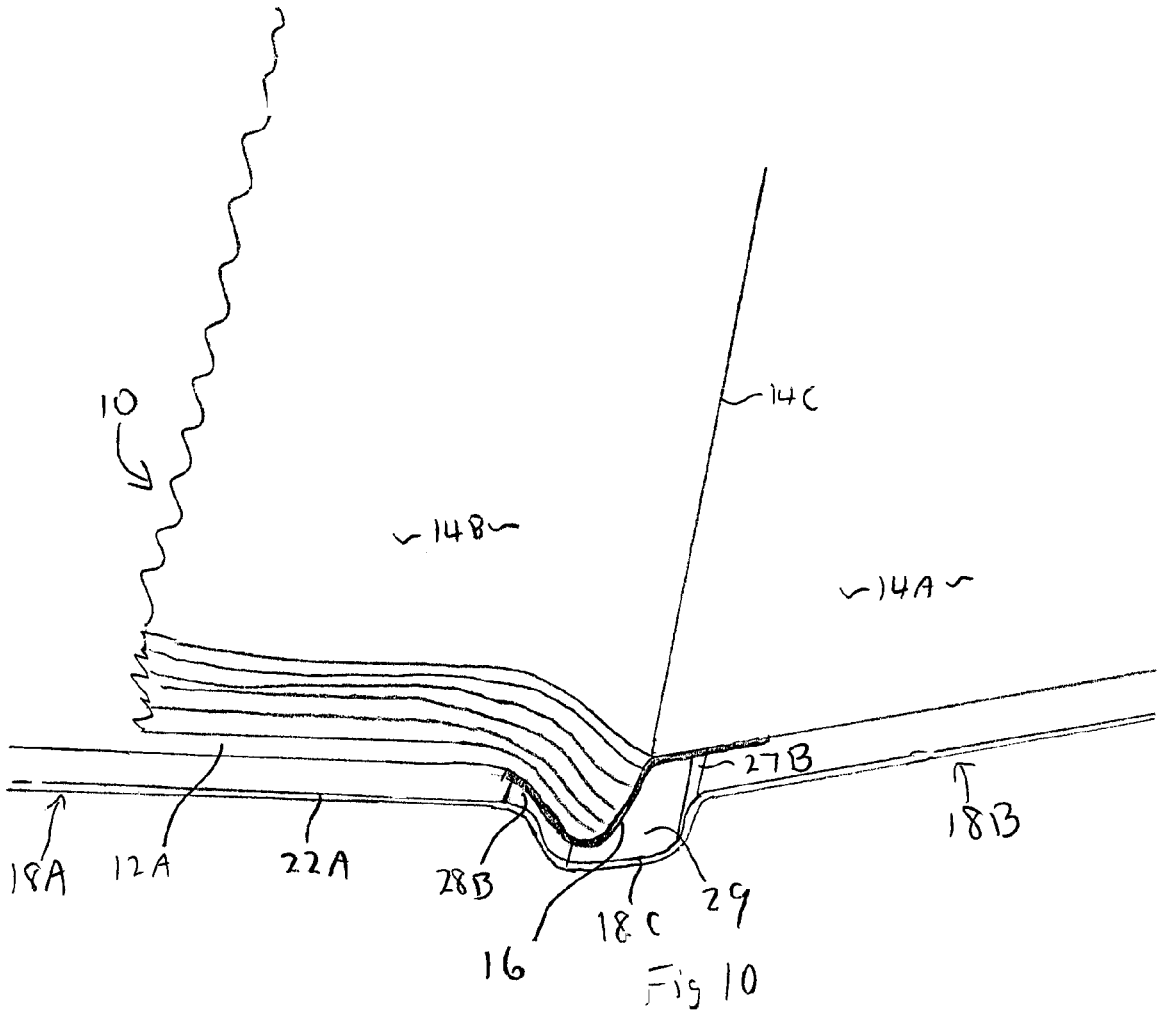
FIG. 10 is a perspective broken view of the completed book shown in an open position.

FIGS. 9A and 9B show the completed book in a closed position and FIG. 10 shows the book in an opened position, at the last page of the book, so that folded liner sheets 14A and 14B are depicted. Sheet 14A is secured to hardcover section 18B by way of adhesive 34B and sheet 12A at the front of the book (not depicted) is secured to hardcover section 18A by adhesive 34A. The region between the binder strip 16 and the spine region 18C is not attached so that, when the book is opened as shown in FIG. 10, the spine region does not attempt to fold with the binder strip 16. Thus, the book will lay flat when opened and will not tend to fold shut. Further, the spine region 18C will not distort when the book is opened to the same degree it would if the spine region 18C was attached. As previously noted, a fairly stiff fabric strip 29 is positioned in the spine region intermediate the gutter regions 28A and 28B (FIG. 3) so as to hold the shape of the spine region 29 when the book is opened and closed. Fold lines 27A and 27B are formed naturally in the membrane 22 in the regions near the edges 25A and 25B of the cover boards thereby further enhancing the appearance of the final product.

Figure 11A:
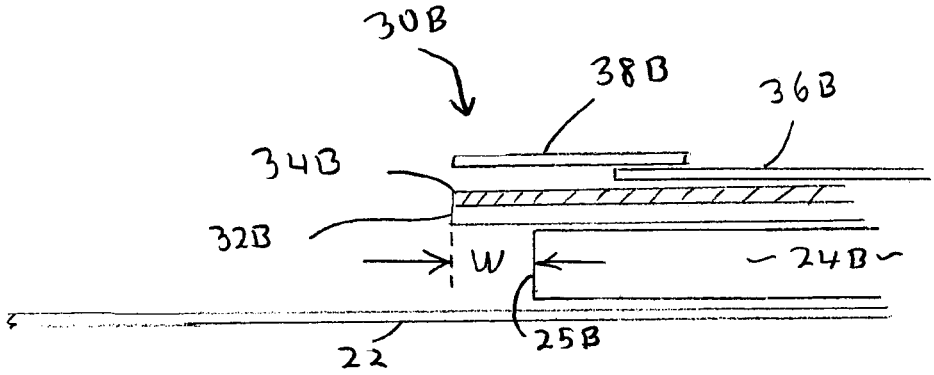
FIGS. 11A-11C depict a further embodiment of the subject hardcover assembly.
Figure 11B:
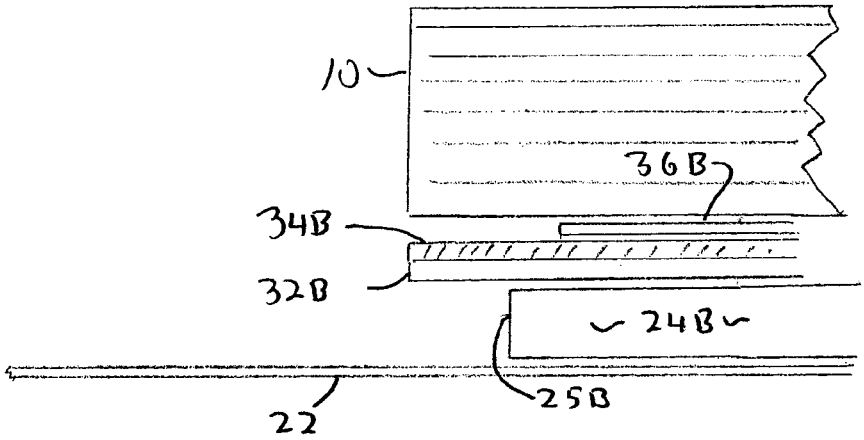
Figure 11C:
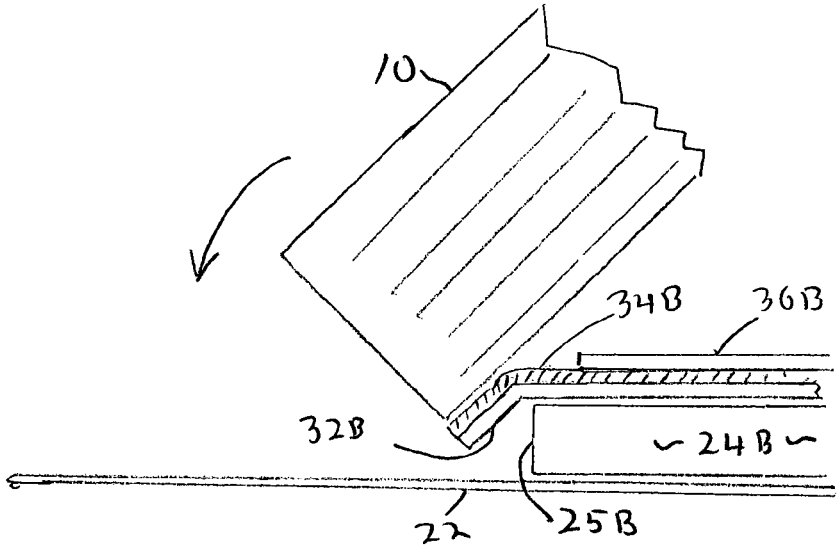

Referring back to FIG. 8E, when the user lifts up the free edge of stack 10 so as to permit the upper release liner 36B to be removed, sometimes there may be a tendency for users to rotate the entire stack about the edge of the stack so as to expose the upper major release liner 36B for removal. This rotation, which is actually not necessary to expose the release liner, tends to cause the stack to be lifted up from the narrow strip of adhesive 34B so that the stack becomes separated from the adhesive thereby destroying the desired placement of the stack on the hard cover section 18B. This problem can be largely eliminated by placing the pressure sensitive adhesive sheet structure (FIG. 3) so that the edge of the structure extends past the edge 25B of cover board 24B by a small amount W as shown in FIG. 11A. FIG. 11A, along with FIGS. 11B and 11C, are schematic in nature for purposes of illustration and are not drawn to scale. The value of W is preferably about ⅜ of an inch, and should be at least 1/16 of an inch.

FIG. 11B, which generally corresponds to FIG. 8D of the binding sequence, shows that stack 10 positioned on the adhesive sheet structure 30B, with the minor release liner 38B removed. Although not shown in FIG. 11B due to the exaggerated thickness of release liner 36B, after the user has pressed down on the edge of stack 10, as shown in FIG. 8D, the stack will come into contact that portion of the exposed pressure sensitive adhesive 34B above cover board 24B, thereby attaching the stack to the hard cover section 18B with the proper orientation. As previously noted, in order to provide access to the major release liner 36B, it is preferred that the user lift, that is fold up, only the outer edge of the stack 10, as shown in FIG. 8E, with the spine region of the stack remaining relatively horizontal. However, there is a tendency to rotate the stack 10 as shown in FIG. 11C, with such rotation tending to cause the stack to separate from the exposed adhesive 34B thereby disrupting the position of the stack relative to the hard cover section 18B.

Figure 12:
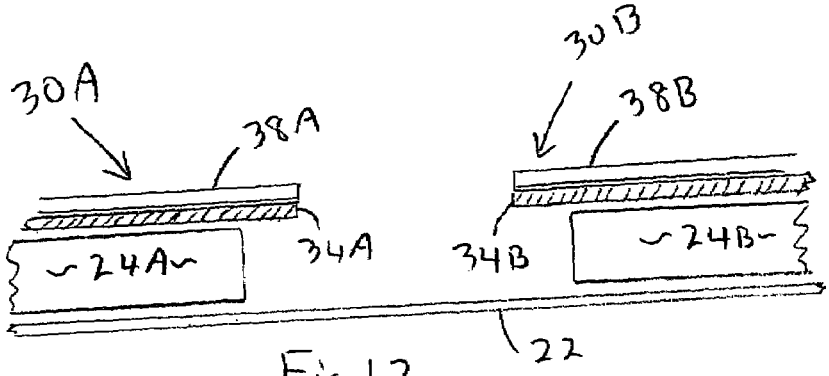
FIG. 12 depicts the further embodiment of the subject hardcover assembly.

As can be seen in FIG. 11C, such rotation will cause the stack to come into contact with the cantilevered portion of exposed adhesive 34B, that portion having dimension W in FIG. 11A. Although the adhesive 34B is supported in this region only by the rigidity of sheet 32B, the adhesive is sufficiently aggressive to cause the stack to adhere when rotation takes place. This action is adequate to keep the stack 10 sufficiently secured to the hard cover section 18B so as to maintain the desired orientation when the user is removing the major release liner 36B as shown in FIG. 8E. For hard cover assemblies where the hard cover sections 18A and 18B are interchangeable (either section could be the front or back book cover), it is preferable to provide both the extension of sheet 32B and adhesive 34B shown in FIG. 11A for sheet structure 30B and a corresponding extension for sheet 32A and adhesive 34A for sheet structure 30A, as shown in FIG. 12 (the bottom sheets 32A and 32B are not shown in FIG. 12).

Figure 13:
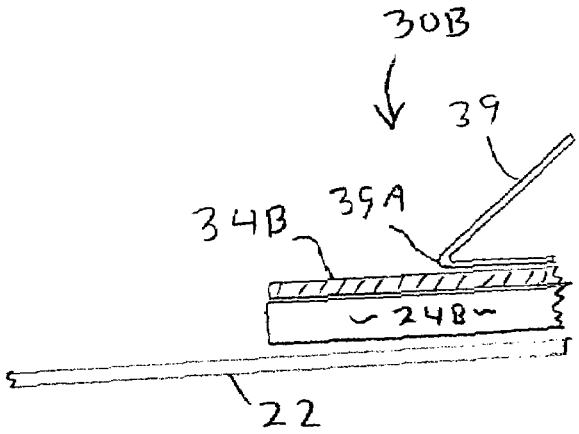
FIG. 13 depicts a still further embodiment of the subject hardcover assembly.
Figure 14:
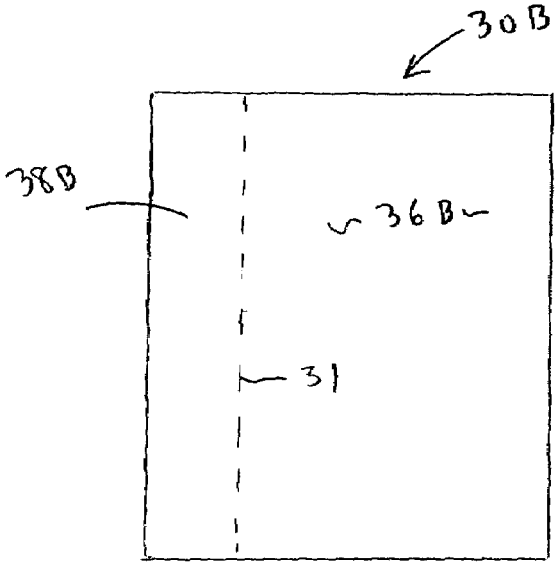
FIG. 14 show an alternative embodiment of the release liners used in the hardcover assembly.

Thus, a novel method of binding a hardcover book has been disclosed. Although one embodiment of the present invention has been described in some detail, it is to be understood that certain changes could be made by those skilled in the art without departing from the scope of the invention as defined by the appended claims. By way of example, it would be possible to have major and minor release liners, such as liners 36B and 38B, formed from one sheet but separated by perforations 31 as shown in FIG. 14. A user would then separate the minor release liner 38B from the major release liner 36B by simply tearing the sheet along the perforations. In addition, it would be possible to use a single release liner for each respective cover section 18A and 18B which covered the entire surface of the pressure sensitive adhesive 34A and 34B. FIG. 13 shows, in schematic form, the single release liner 39 as part of adhesive sheet structure 30B (the bottom sheet 32B is not shown). At the step which corresponds to FIG. 8B, the user folds the release liner 39 at fold line 39A over on itself to expose a narrow strip of adhesive 34B near the spine. The user then places the stack 10 on the folded release liner, similar to the step shown in FIG. 8C and forces the stack 10 down on the exposed adhesive, similar to the step shown in FIG. 8D. The stack 10 is then resting on the exposed adhesive and the folded release liner 39. The user then lifts the edge of the stack and removes the folded release liner 39 in a manner similar to the removal of liner 36B shown in FIG. 8E. A similar folding step can be carried out in connection with the step shown in FIG. 8H in connection with release liner 36A. This approach is not preferred since the user has to carry out the additional folding steps.

What is claimed is:

1. A method of fabricating a hardcover book comprising:

providing a bound stack of sheets;

providing a hardcover assembly including first and second relatively rigid cover sections connected by an intermediate spine section, with the first cover section including a first pressure sensitive adhesive layer which extends over substantially an entire inner surface of the first cover section and first and second release liners disposed over the first pressure sensitive adhesive layer;

separating the first release liner from the first cover section thereby exposing only a first portion of the first pressure sensitive adhesive layer;

positioning the bound stack and the first cover section so that a first outer sheet of the bound stack comes in contact with the exposed first portion of the first pressure sensitive adhesive layer;

subsequent to the positioning, separating the second release liner from the first cover section thereby exposing a remaining portion of the first pressure sensitive adhesive layer; and bringing the first outer sheet and the bound stack and the remaining portion of the first pressure sensitive adhesive into contact with one another, with substantially an entire surface of the first outer sheet of the stack being secured to the inner surface of the first cover section by the first pressure sensitive adhesive layer.

2. The method of claim 1 wherein the second cover section of the hardcover assembly further includes a covered second pressure sensitive adhesive layer which extends over substantially an entire inner surface of the second cover section and wherein the method further includes, subsequent to the bring the first outer sheet and the remaining portion of the first pressure sensitive adhesive into contact with one another:

exposing the second pressure sensitive adhesive layer; and positioning the bound stack and the second cover section so that a second outer sheet of the bound stack, opposite the first outer sheet, comes in contact with the exposed second pressure sensitive adhesive layer, with substantially an entire surface of the second outer sheet being secured to the inner surface of the second cover section by the second pressure sensitive adhesive layer.

3. The method of claim 2 wherein the first portion of the first pressure sensitive adhesive layer forms a first adhesive strip which is disposed on the inner surface of the first cover section along the spine section of the hardcover assembly, with the remaining portion of the first pressure sensitive adhesive layer forming at least 75% of the first pressure sensitive adhesive layer.

4. The method of claim 3 further including providing a guide apparatus which includes a receiving surface, a stop member having respective first and second stop surfaces, with the first stop surface being positioned to engage a first edge of the first cover section when the hardcover assembly is placed on the receiving surface and wherein the second stop surface is being positioned to engage a first edge of the bound stack when the first cover section is positioned on the receiving surface and the bound stack is positioned on the first cover section, with the first and second stop surfaces being at differing positions along a line parallel to the receiving surface and wherein the positioning the bound stack and the first cover section includes positioning the first cover section and the bound stack on the guide apparatus so that the first edge of the first cover section engages the first stop surface and the first edge of the bound stack engages the second stop surface.

5. The method of claim 4 wherein the stop member of the guide apparatus further includes a third stop surface aligned at the same position along the line parallel to the receiving surface as the first stop surface and wherein the positioning the bound stack and the second cover section includes positioning the hardcover assembly and the bound stack on the guide apparatus so that the first edge of the first cover section and a first edge of the second cover section engage the respective first and third stop surfaces.

6. The method of claim 5 wherein the stop member further includes fourth, fifth and sixth stop surfaces displaced from the first, second and third stop surfaces, with the fourth, fifth and sixth stop surfaces having a position relative to one another corresponding to the respective first, second and third stop surfaces and wherein the positioning the bound stack and the first cover section includes the positioning the first cover section and the bound stack on the guide apparatus so that the first edge of the first cover section and a second edge of the first cover section, orthogonal to the first edge of the first cover section, engage the first and fourth stop surfaces, respectively, and so that first edge of the bound stack and a second edge of the bound stack, orthogonal to the first edge of the bound stack, engage the second and fifth stop surfaces respectively.

7. The method of claim 6 wherein the positioning the bound stack and the second cover section includes positioning the hardcover assembly and the bound stack on the guide apparatus so the first edge of the first cover section and a second edge of the first cover section, orthogonal with respect to the first edge of the first cover section, engage the first and fourth stop surfaces, respectively, and so that the first edge of the second cover section and a second edge of the second cover section, orthogonal to the first edge of the second cover section, engage the third and sixth stop surfaces, respectively.

8. A method of fabricating a hardcover book comprising:

providing a bound stack of sheets, including first and second outer sheets disposed on opposite side of the stack;

providing a hardcover assembly including first and second relatively rigid cover sections connected by an intermediate spine section, with the first cover section including a first pressure sensitive adhesive layer distributed over substantially an entire inner surface of the first cover section, with said first pressure sensitive adhesive layer consisting essentially of first and second adhesive portions and a first release liner disposed over the first pressure sensitive adhesive layer and with the second cover section including a second pressure sensitive adhesive layer distributed over substantially an entire inner surface of the second cover section and a second release liner disposed over the second pressure sensitive adhesive layer;

removing a first segment of the first release liner from the first adhesive portion of the first pressure sensitive adhesive thereby exposing the first adhesive portion;

positioning the bound stack and the first cover section so that the first outer sheet of the bound stack comes in contact with the exposed first adhesive portion of the first pressure sensitive adhesive layer;

subsequent to the positioning, removing a second segment of the first release liner from the second, adhesive portion thereby exposing the second adhesive portion of the first pressure sensitive adhesive layer; and bringing the first outer sheet of the bound stack and the exposed second adhesive portion of the first pressure sensitive adhesive layer into contact with one another, with substantially an entire surface of the first outer sheet of the stack being secured to the inner surface of the first cover section by the first pressure sensitive adhesive layer.

9. The method of claim 8 wherein the removing the first segment of the first release liner includes folding the first release liner so that the first segment is displaced from the first adhesive portion of the first pressure sensitive adhesive.

10. The method of claim 9 wherein the removing the second segment of the first release liner includes separating the first release liner from the first pressure sensitive adhesive layer.

11. The method of claim 8 wherein the first and second segments of the first release liner are separate segments and wherein the removing the first segment includes lifting the first segment of the first release liner away from the second segment of the first release liner.

12. The method of claim 8 wherein the first and second segments of the first release liner are attached together by a section having perforations and wherein the removing the first segment of the release liner includes tearing the first release liner along the perforations.

13. The method of claim 8 wherein the subsequent to the bringing the first outer sheet of the bound stack and the exposed second adhesive portion of the first pressure sensitive adhesive layer into contact, the method includes removing the second release liner from the second pressure sensitive adhesive layer and bringing the second outer sheet of the bound stack and the second pressure sensitive adhesive layer into contact with one another, with substantially an entire surface of the second outer sheet being secured to the inner surface of the second cover section by the second pressure sensitive layer.

14. The method of claim 13 wherein the second pressure sensitive adhesive layer consists essentially of first and second adhesive portions and wherein the bringing the second outer sheet of the bound stack and the second pressure sensitive adhesive layer into contact with one another includes exposing the first portion of the second pressure sensitive adhesive layer, bringing the second outer sheet of the bound stack into contact with the exposed first portion of the second pressure sensitive adhesive layer and then exposing the second portion of the second pressure sensitive adhesive layer and bringing the second outer sheet of the bound stack into contact with the exposed second portion of the second pressure sensitive adhesive layer.

15. A method of fabricating a hardcover book comprising:

providing a stack of sheets, including first and second outer sheets disposed on opposite sides of the stack;

providing a hardcover assembly including first and second relatively rigid cover sections connected by an intermediate spine section, with the first cover section including a first unexposed pressure sensitive adhesive layer distributed over substantially an entire inner surface of the first cover section;

exposing only a first portion of the first pressure sensitive adhesive layer;

positioning the stack and the first cover section so that the first sheet of the stack comes in contact with the exposed first portion of the first pressure sensitive adhesive layer;

subsequent to the positioning, exposing a second portion of the first pressure sensitive adhesive layer; and bringing the the first sheet of the stack and the second portion of the first pressure sensitive adhesive layer into contact with one another with substantially an entire surface of the first outer sheet being secured to the inner surface of the first cover section by the first pressure sensitive adhesive layer.

16. The method of claim 15 wherein the second cover section of the hardcover assembly further includes an unexposed second pressure sensitive adhesive layer distributed over substantially an entire inner surface of the second cover section and wherein the method further includes:

subsequent to the bringing the first outer sheet and the second portion of the first pressure sensitive adhesive layer into contact with one another, exposing the second pressure sensitive adhesive layer; and positioning the stack and the second cover section so that the second outer sheet of the stack comes in contact with the exposed second pressure sensitive adhesive layer;

exposing a second portion of the second pressure sensitive adhesive layer; and bringing the second outer sheet of the bound stack and the second portion of the second pressure sensitive adhesive layer into contact with one another, with substantially an entire surface of the second outer sheet being secured to the inner surface of the second cover section by the second pressure sensitive adhesive layer.

* * * * *